US012798822B2

(12) United States Patent
Goodman

(10) Patent No.: US 12,798,822 B2
(45) Date of Patent: Nov. 17, 2026

(54) BATTERY STORAGE AND TRANSPORT SYSTEM

(71) Applicant: Redwood Materials, Inc., Carson City, NV (US)

(72) Inventor: Jacob Daniel Goodman, Laguna Niguel, CA (US)

(73) Assignee: Redwood Materials, Inc., Carson City, NV (US)

( * ) Notice: Subject to any disclaimer, the term of this patent is extended or adjusted under 35 U.S.C. 154(b) by 0 days.

(21) Appl. No.: 19/034,145

(22) Filed: Jan. 22, 2025

(65) Prior Publication Data

US 2025/0236433 A1 Jul. 24, 2025

Related U.S. Application Data

(60) Provisional application No. 63/624,239, filed on Jan. 23, 2024.

(51) Int. Cl.
*B65D 1/36* (2006.01)
*B65D 21/04* (2006.01)
(Continued)

(52) U.S. Cl.
CPC ..... *B65D 1/36* (2013.01); *B65D 21/04* (2013.01); *B65D 85/68* (2013.01); *B65D 2585/88* (2013.01)

(58) Field of Classification Search
CPC ..... B65D 1/36; B65D 21/04; B65D 2585/88; B65D 85/68; B65D 1/00; B65D 1/24;
(Continued)

(56) References Cited

U.S. PATENT DOCUMENTS 4,282,975 A 8/1981 Ovadia
10,910,612 B2 * 2/2021 Sugimoto ..... B65D 71/70
(Continued)

FOREIGN PATENT DOCUMENTS

CN 200956441 U 1/2020
CN 215285931 U * 12/2021
(Continued)

OTHER PUBLICATIONS

International Search Report and Written Opinion as received in PCT/US2025/012604 dated Mar. 18, 2025.
(Continued)

*Primary Examiner* — Anthony D Stashick
*Assistant Examiner* — Marcos Javier Rodriguez Molina
(74) *Attorney, Agent, or Firm* — Keller Preece PLLC

(57) ABSTRACT

The present disclosure relates to systems, devices, and methods for storing and transporting used battery cells. In particular, in one or more embodiments, the disclosed systems provide a battery cell storage and transportation system that includes a plurality of battery cell storage and transportation trays. The battery cell storage and transportation trays can be stacked and can encapsulate individual battery cells in a vertical orientation within dedicated cavities. Moreover, the battery cell storage and transportation trays can include isolation cavities for terminals of the battery cells. Furthermore, in some embodiments, the disclosed systems provide for a series of battery cell storage and transportation trays to be stacked and placed onto a pallet base for storage and/or transportation.

20 Claims, 12 Drawing Sheets

(51) Int. Cl.

| | |
|---|---|
| ***B65D 85/68*** | (2006.01) |
| *H01M 10/0525* | (2010.01) |
| *H01M 10/54* | (2006.01) |
| *H01M 50/204* | (2021.01) |
| *H01M 50/24* | (2021.01) |

(58) Field of Classification Search

CPC ..... B65D 1/34; B65D 1/40; B65D 1/46; B65D 11/18; B65D 11/1853; B65D 11/1866; B65D 11/188; B65D 11/22; B65D 19/00; B65D 19/0002; B65D 19/0004; B65D 19/0006; B65D 19/0008; B65D 19/0012; B65D 19/002; B65D 19/0036; B65D 19/0038; B65D 19/004; B65D 19/0042; B65D 19/0053; B65D 19/0055; B65D 19/0077; B65D 19/0089; B65D 19/0091; B65D 19/0093; B65D 19/0095; B65D 19/02; B65D 19/06; B65D 19/08; B65D 19/10; B65D 19/18; B65D 19/38; B65D 19/385; B65D 19/40; B65D 19/42; B65D 19/44; B65D 21/0201; B65D 21/0202; B65D 21/0204; B65D 21/0209; B65D 21/0212; B65D 21/0213; B65D 21/0215; B65D 21/0217; B65D 21/0222; B65D 21/0224; B65D 21/0228; B65D 21/023; B65D 21/0233; B65D 21/0234; B65D 21/045; B65D 21/08; B65D 21/086; B65D 2203/00; B65D 2203/10; B65D 2205/02; B65D 2301/20; B65D 2313/00; B65D 25/00; B65D 25/005; B65D 25/02; B65D 25/04; B65D 25/06; B65D 25/10; B65D 25/101; B65D 25/105; B65D 25/107; B65D 25/108; B65D 25/14; B65D 25/22; B65D 25/24; B65D 25/2805; B65D 25/2882; B65D 25/36; B65D 25/38; B65D 25/52; B65D 25/54; B65D 2501/24872; B65D 2519/00009; B65D 2519/00024; B65D 2519/00034; B65D 2519/00059; B65D 2519/00069; B65D 2519/00094; B65D 2519/00104; B65D 2519/00124; B65D 2519/00129; B65D 2519/00134; B65D 2519/00273; B65D 2519/00288; B65D 2519/00293; B65D 2519/00298; B65D 2519/00323; B65D 2519/00333; B65D 2519/00338; B65D 2519/00343; B65D 2519/00353; B65D 2519/00373; B65D 2519/00407; B65D 2519/00412; B65D 2519/00417; B65D 2519/00432; B65D 2519/00437; B65D 2519/00442; B65D 2519/00537; B65D 2519/00547; B65D 2519/00557; B65D 2519/00562; B65D 2519/00567; B65D 2519/00781; B65D 2519/00786; B65D 2519/00796; B65D 2519/00815; B65D 2519/0082; B65D 2519/00825; B65D 2519/0086; B65D 2519/0094; B65D 2519/00955; B65D 2519/0096; B65D 2519/00965; B65D 2519/00975; B65D 2519/0098; B65D 2519/0099; B65D 2525/284; B65D 2543/00027; B65D 2543/00101; B65D 2543/00296; B65D 2543/00509; B65D 2543/00537; B65D 2543/00555; B65D 2543/00972; B65D 2565/385; B65D 2571/00012; B65D 2571/00018; B65D 2571/0003; B65D 2571/00043; B65D 2571/00055; B65D 2571/00061; B65D 2571/00074; B65D 2571/00111; B65D 2571/00123; B65D 2571/00141; B65D 2571/0016; B65D 2571/00172; B65D 2571/00185; B65D 2571/00277; B65D 2571/0029; B65D 2571/00296; B65D 2571/00302; B65D 2571/00401; B65D 2571/00444; B65D 2571/00469; B65D 2571/00543; B65D 2571/0058; B65D 2571/0066; B65D 2571/00716; B65D 2571/00728; B65D 2571/00796; B65D 2575/3227; B65D 2575/3245; B65D 2575/586; B65D 2581/055; B65D 2581/057; B65D 2581/3405; B65D 2581/3472; B65D 2581/3497; B65D 2581/3498; B65D 2585/86; B65D 2590/0058; B65D 43/02; B65D 43/0212; B65D 43/0214; B65D 43/0218; B65D 43/162; B65D 43/163; B65D 43/164; B65D 45/16; B65D 5/0015; B65D 5/002; B65D 5/003; B65D 5/0045; B65D 5/0227; B65D 5/2019; B65D 5/2033; B65D 5/2038; B65D 5/2047; B65D 5/22; B65D 5/241; B65D 5/302; B65D 5/3642; B65D 5/4204; B65D 5/4233; B65D 5/4237; B65D 5/46; B65D 5/4612; B65D 5/46192; B65D 5/48022; B65D 5/5021; B65D 5/5023; B65D 5/503; B65D 5/5035; B65D 5/5038; B65D 5/504; B65D 5/54; B65D 5/5425; B65D 5/6611; B65D 5/667; B65D 5/724; B65D 51/1644; B65D 51/24; B65D 53/00; B65D 55/02; B65D 55/14; B65D 59/00; B65D 59/02; B65D 61/00; B65D 65/38; B65D 65/40; B65D 65/42; B65D 65/466; B65D 7/24; B65D 7/36; B65D 7/44; B65D 71/00; B65D 71/0003; B65D 71/0092; B65D 71/0096; B65D 71/02; B65D 71/04; B65D 71/08; B65D 71/10; B65D 71/12; B65D 71/125; B65D 71/16; B65D 71/22; B65D 71/36; B65D 71/42; B65D 71/46; B65D 71/70; B65D 71/72; B65D 73/0057; B65D 75/004; B65D 75/24; B65D 75/323; B65D 75/326; B65D 75/327; B65D 75/527; B65D 75/56; B65D 75/5838; B65D 77/003; B65D 77/02; B65D 77/04; B65D 77/0406; B65D 77/042; B65D 77/0466; B65D 77/08; B65D 77/20; B65D 77/2024; B65D 77/2032; B65D 77/2092; B65D 79/02; B65D 81/02; B65D 81/022; B65D 81/025; B65D 81/027; B65D 81/03; B65D 81/05; B65D 81/053; B65D 81/07; B65D 81/1075; B65D 81/113; B65D 81/127; B65D 81/133; B65D 81/18; B65D 81/203; B65D 81/2076; B65D 81/22; B65D 81/264; B65D 81/266; B65D 81/3453; B65D 81/3813; B65D 83/02; B65D 83/08; B65D 83/76; B65D 83/761; B65D 85/00; B65D 85/04; B65D 85/10; B65D 85/20; B65D 85/30; B65D 85/307; B65D 85/34; B65D 85/36; B65D 85/50; B65D 85/52; B65D 85/62; B65D 85/671; B65D 85/672; B65D

85/70; B65D 85/76; B65D 88/005; B65D 88/02; B65D 88/027; B65D 88/129; B65D 88/522; B65D 88/546; B65D 88/741; B65D 9/12; B65D 90/00; B65D 90/004; B65D 90/0066; B65D 90/02; B65D 90/08; H01M 10/0525; H01M 10/54; H01M 2220/20; H01M 50/204; H01M 50/24; H01M 10/04; H01M 10/0404; H01M 10/0422; H01M 10/0427; H01M 10/0431; H01M 10/0468; H01M 10/0481; H01M 10/056; H01M 10/058; H01M 10/0587; H01M 10/06; H01M 10/42; H01M 10/4207; H01M 10/4228; H01M 10/4235; H01M 10/4242; H01M 10/4264; H01M 10/4285; H01M 10/445; H01M 10/446; H01M 10/448; H01M 10/482; H01M 10/484; H01M 10/486; H01M 10/60; H01M 10/613; H01M 10/62; H01M 10/623; H01M 10/625; H01M 10/635; H01M 10/643; H01M 10/647; H01M 10/654; H01M 10/655; H01M 10/6554; H01M 10/6555; H01M 10/6561; H01M 10/6562; H01M 10/6566; H01M 10/6567; H01M 10/657; H01M 10/6571; H01M 10/659; H01M 10/66; H01M 10/663; H01M 2004/028; H01M 2010/4271; H01M 2200/10; H01M 2200/103; H01M 2220/30; H01M 2300/0085; H01M 4/04; H01M 4/0459; H01M 4/0471; H01M 4/06; H01M 4/1393; H01M 4/16; H01M 4/20; H01M 4/583; H01M 4/628; H01M 50/10; H01M 50/103; H01M 50/112; H01M 50/114; H01M 50/121; H01M 50/124; H01M 50/126; H01M 50/131; H01M 50/133; H01M 50/152; H01M 50/1537; H01M 50/167; H01M 50/169; H01M 50/176; H01M 50/186; H01M 50/20; H01M 50/209; H01M 50/211; H01M 50/218; H01M 50/22; H01M 50/222; H01M 50/231; H01M 50/233; H01M 50/242; H01M 50/251; H01M 50/253; H01M 50/262; H01M 50/264; H01M 50/267; H01M 50/273; H01M 50/276; H01M 50/284; H01M 50/289; H01M 50/296; H01M 50/298; H01M 50/30; H01M 50/342; H01M 50/3425; H01M 50/375; H01M 50/383; H01M 50/449; H01M 50/46; H01M 50/461; H01M 50/463; H01M 50/471; H01M 50/48; H01M 50/50; H01M 50/502; H01M 50/503; H01M 50/505; H01M 50/507; H01M 50/509; H01M 50/51; H01M 50/512; H01M 50/516; H01M 50/517; H01M 50/519; H01M 50/522; H01M 50/526; H01M 50/528; H01M 50/529; H01M 50/531; H01M 50/533; H01M 50/536; H01M 50/538; H01M 50/54; H01M 50/543; H01M 50/547; H01M 50/548; H01M 50/55; H01M 50/552; H01M 50/553; H01M 50/557; H01M 50/559; H01M 50/56; H01M 50/561; H01M 50/564; H01M 50/569; H01M 50/572; H01M 50/574; H01M 50/576; H01M 50/578; H01M 50/583; H01M 50/586; H01M 50/588; H01M 50/59; H01M 50/593; H01M 50/597; H01M 50/60; H01M 50/609; H01M 50/618; H01M 50/627; H01M 50/636; H01M 50/645; H01M 50/673; H01M 50/691; H01M 6/00; H01M 6/005; H01M 6/06; H01M 6/14; H01M 6/16; H01M 6/42; H01M 6/5083; H01M 6/5088; H01M 6/52; H01M 8/00; H01M 8/0276; H01M 8/04014; H01M 8/04276; H01M 8/04373; H01M 8/0438; H01M 8/04417; H01M 8/04567; H01M 8/04597; H01M 8/04664; H01M 8/04701; H01M 8/04768; H01M 8/0491; H01M 8/0612; H01M 8/1018; H01M 8/188; H01M 8/2465; H01M 8/2475

USPC ..... 206/703, 446, 509, 518, 519; 211/128.1, 211/50, 55, 71.01

See application file for complete search history.

(56) References Cited

U.S. PATENT DOCUMENTS

| | | | | |
|---|---|---|---|---|
| 2010/0330404 | A1* | 12/2010 | Nishino | H01M 50/213 429/82 |
| 2013/0134067 | A1* | 5/2013 | Ramirez | B65D 1/36 264/156 |
| 2014/0166532 | A1* | 6/2014 | Sugimoto | B65D 71/70 206/703 |
| 2014/0197064 | A1* | 7/2014 | Prince | B65D 21/023 53/448 |
| 2022/0355968 | A1* | 11/2022 | Lee | B65D 21/0213 |

FOREIGN PATENT DOCUMENTS

| | | | | |
|---|---|---|---|---|
| CN | 117401277 | A * | 1/2024 | B65D 19/44 |
| KR | 20210006181 | A * | 1/2021 | H01M 50/152 |
| WO | WO-2018131926 | A1 * | 7/2018 | C08J 7/0427 |
| WO | WO-2022091926 | A1 * | 5/2022 | H01M 50/256 |

OTHER PUBLICATIONS

Lithium cells and batteries (§173.185) Title 49. [online]. National Archives—Code of Federal Regulations, 2025, 7 pages, [retrieved on Mar. 27, 2025]. Retrieved from the Internet: <URL: https://www.ecfr.gov/current/title-49/subtitle-B/chapter-I/subchapter-C/part-173/subpart-E/section-173.185>.

* cited by examiner

BATTERY STORAGE AND TRANSPORT SYSTEM

RELATED APPLICATIONS

This application claims priority to and the benefit of U.S. Provisional Patent Application No. 63/624,239, filed on Jan. 23, 2024 and titled "BATTERY STORAGE AND TRANSPORT SYSTEM," the contents of which are hereby incorporated by reference herein in their entirety.

BACKGROUND

Recent years have seen a significant increase in the implementation of various types of batteries as an alternative to fossil fuels and other sources of energy. Moreover, the recent surge in popularity of electric vehicles and other electronic devices containing batteries has resulted in a significant increase in demand for battery production, as well as an increased demand for safe and efficient recycling or disposal of batteries and battery materials.

Despite advances in battery production and implementation in various fields of use, existing methods for mass collection, recycling and/or disposal of batteries and battery materials face several shortcomings. For example, conventional systems can recycle or dispose of batteries of particular chemical compositions, contained energies, or form factors, such as various types of lithium-ion batteries. However, certain compositions of batteries or devices are unstable and unsafe when improperly handled. Accordingly, conventional methods for collecting batteries or devices from users require a trained handler to receive and personally prepare each battery or device for safe transportation to a recycling facility. For example, conventional methods require the trained handler to tape the terminals of each battery and place each battery or device in a separate bag or container. Moreover, additional safety measures are generally required to ensure immediate response in case of a thermal event caused by disposed batteries or devices.

Further, conventional systems for mass collection, recycling, and/or disposal of batteries and battery materials often require the use of disposable bags or other materials consumed in use. Such uses produce waste and are unable to be effectively reused to conserve resources.

These along with additional problems and issues exist with regard to conventional systems for storing and transporting batteries.

BRIEF SUMMARY

Embodiments of the present disclosure provide benefits and/or solve one or more of the foregoing or other problems in the art with systems, devices, and methods for safely storing and transporting battery cells for disposal or recycling. For example, the disclosed systems provide a battery cell storage and transportation system by which transporters may safely package battery cells in a set of packaging trays. The packaging trays can store and allow for transport of batteries without requiring individual packaging. The disclosed systems also allow for stacking of packaging trays to hold battery cells more efficiently for mass storage and transport, all while complying with applicable governmental safety regulations.

To illustrate, in some embodiments, a system for storing and transporting battery cells includes a series of trays configured to store and secure batteries. The trays can contain cavities that allow for insertion of individual battery cells. Furthermore, the trays can contain dedicated silos to isolate terminal ends of the battery cells stored within. In addition, the trays can form a complete case around battery cells when stacked one on top of another. The stacked trays can hold battery cells within individual cavities formed by pairs of trays. Moreover, in some embodiments, the trays contain a plurality of slots on both the top sides and bottom sides to enclose a plurality of battery cells. In some embodiments, the trays are configured to be loaded on to a pallet-type device for ease of transport.

The following description sets forth additional features and advantages of one or more embodiments of the disclosed systems, devices, and methods. In some cases, such features and advantages are evident to a skilled artisan having the benefit of this disclosure, or may be learned by the practice of the disclosed embodiments.

BRIEF DESCRIPTION OF THE DRAWINGS

The detailed description provides one or more embodiments with additional specificity and detail through the use of the accompanying drawings, as briefly described below.

DETAILED DESCRIPTION

Figure 1:
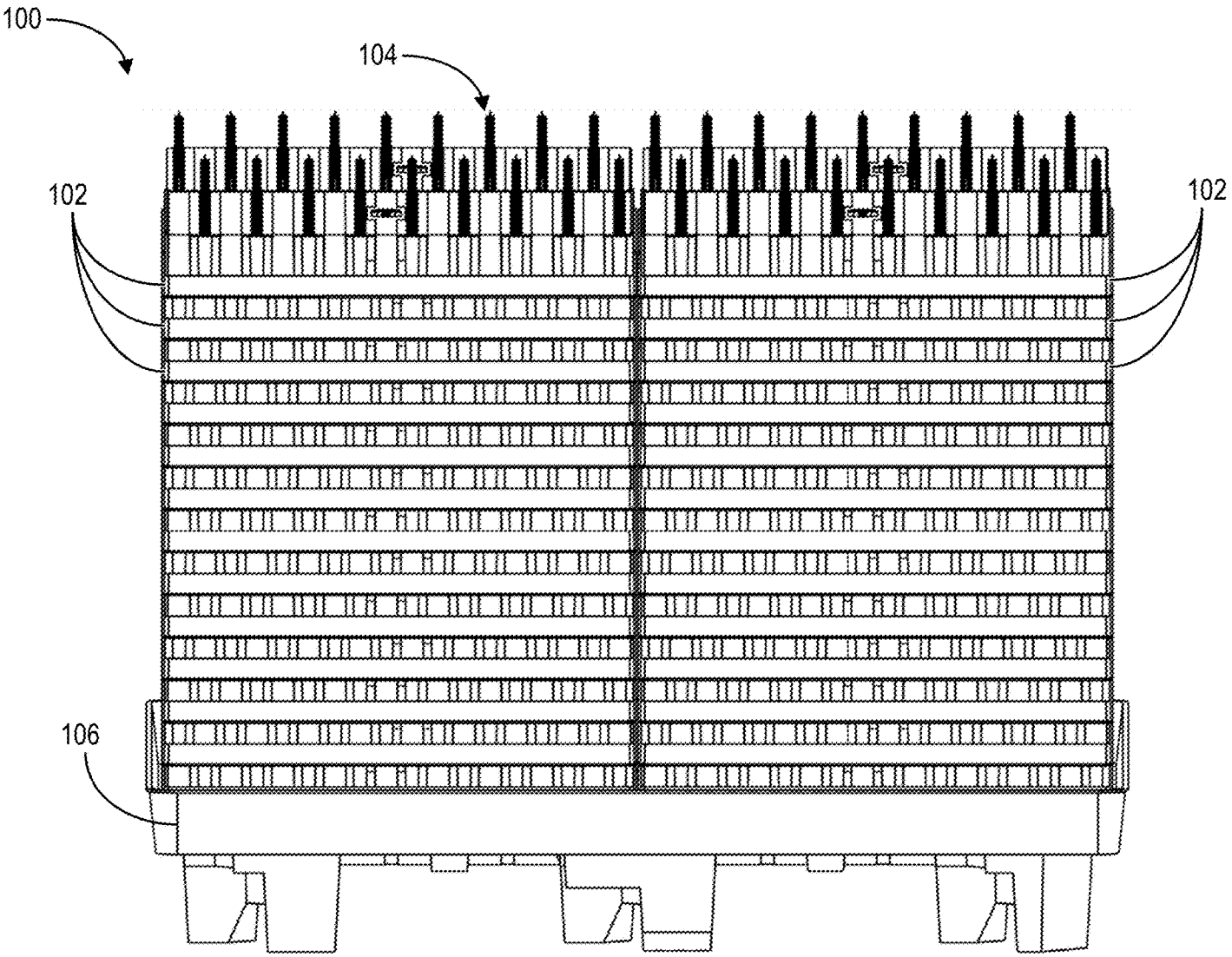
FIG. 1 illustrates a perspective view of a battery cell storage and transportation system in accordance with one or more embodiments.

This disclosure describes one or more embodiments of systems, devices, and methods for battery cell storage and transportation. In some embodiments, a battery cell storage and transportation system includes one or more battery cell storage and transportation trays. The battery cell storage and transportation trays can be stacked into groups for loading onto a pallet for storage and/or transportation. For example, in some implementations, the battery cell storage and transportation system utilizes a series of nested trays that include battery cell cavities to hold and enclose used battery cells. Furthermore, in some embodiments, the battery cell storage and transportation system utilizes a battery cell transportation tray that holds a lower portion of a vertically stored battery cell while a second battery cell transportation tray can be layered on top to encapsulate an upper portion of the vertically stored battery cell.

In some embodiments, for example, the battery cell storage and transportation system includes battery cell storage and transportation trays layered over one another to encapsulate a set of battery cells. In some embodiments, the battery cell storage and transportation trays can be made of a non-conductive and corrosive resistant recycled high-density polyethylene (rHDPE). Additionally, in some implementations, the battery cell storage and transportation system is configured to nest trays one on top of another so that there is an overhang covering each set of battery cells to repel dust and environmental debris. Moreover, in some embodiments, the battery cell storage and transportation system is configured so that each set of battery cells is staggered with the next set of battery cells (e.g., directly above and/or directly below) in a vertical stack. Thus, the battery cells can be laterally offset to efficiently utilize space (e.g., by keeping the battery cells as close to one another as possible) while keeping the battery cells insulated from each other in the battery cell storage and transportation system.

As just mentioned, in some embodiments, the battery cell storage and transportation system includes a series of battery cell storage and transportation trays layered over one another to store several sets of battery cells. In some embodiments, the battery cell storage and transportation trays interlock one with another to form a unit for storage and/or transportation via a pallet. In some embodiments, the battery cell storage and transportation trays can be loaded onto a pallet-type tray for transportation. Furthermore, in some embodiments, the battery cell storage and transportation trays can then be fastened via a set of webbed belts and reinforced steel buckles to hold and constrict the battery cell storage and transportation trays on the pallet. Additionally, in some embodiments, the webbed belt and reinforced steel buckles can keep a full package of battery cell storage and transportation trays unitized for transportation and storage as a discrete unit.

Additional detail will now be provided in relation to illustrative figures portraying example embodiments and implementations of the disclosed systems. For instance, FIG. 1 illustrates a battery cell storage and transportation system 100 according to one or more embodiments. The battery cell storage and transportation system 100 can include one or more battery cell storage and transportation trays 102. In some embodiments, multiple battery cell storage and transportation trays 102 can be stacked (e.g., one tray on top of another tray) to form a stack of battery cell storage and transportation trays. In some embodiments, a stack of battery cell storage and transportation trays can include a plurality of trays (e.g., five, eight, fourteen, etc.) to facilitate the storage and protection of numerous battery cells. For example, the battery cell storage and transportation trays 102 can be stacked modularly to fit many battery cells in the battery cell storage and transportation system 100 for storage and/or transportation.

In one or more implementations, the battery cell storage and transportation trays 102 can hold a set of battery cells 104. In some implementations, the battery cells 104 are positioned vertically (or substantially vertically) within the battery cell storage and transportation trays 102. The battery cell storage and transportation trays 102 can be stacked on top of a base 106 for storage and/or transport. In some embodiments, the base 106 is a pallet base. In one or more embodiments, the base 106 has a footprint of fifty-four inches by forty-eight inches. In some implementations, the size of the base 106 has other footprint dimensions (e.g., forty-eight inches by forty inches). In some embodiments, the base 106 facilitates the battery cell storage and transportation system 100 being lifted and moved using standard pallet methods (e.g., via a forklift truck).

Figure 2A:
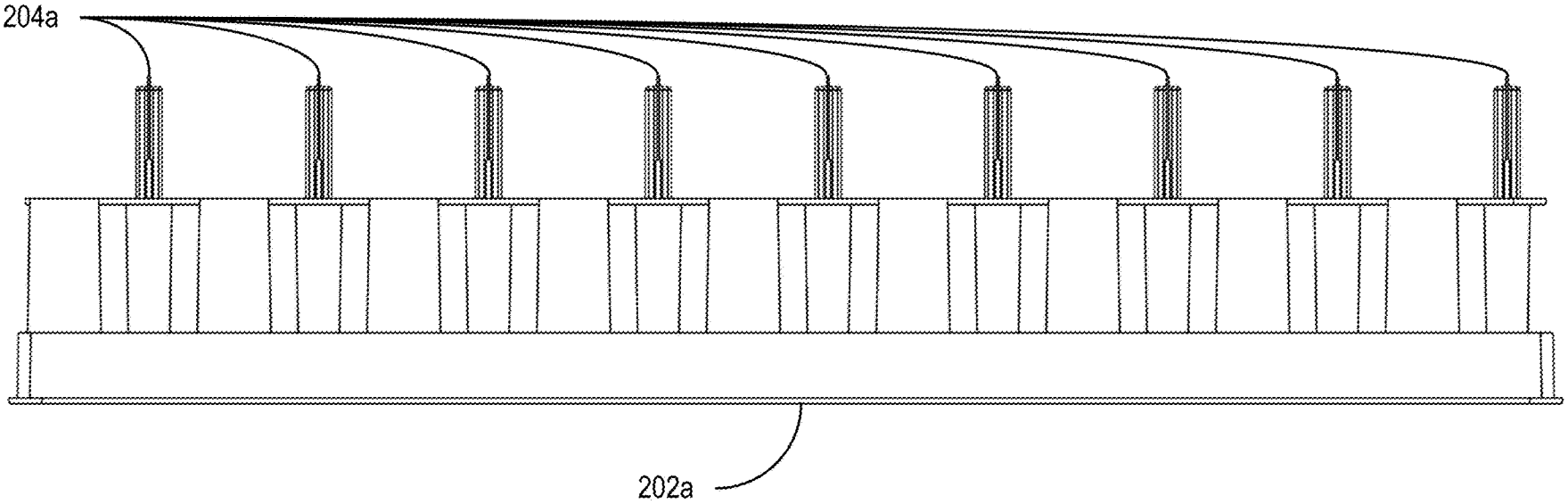
FIG. 2A illustrates a side view of a tray of a battery cell storage and transportation system with battery cells positioned in slots of the tray in accordance with one or more embodiments.

In some embodiments, the battery cell storage and transportation trays can be stacked one on top of another to hold battery cells in a nested configuration. For example, FIG. 2A illustrates a first battery cell storage and transportation tray 202*a* holding a first set of battery cells 204*a*, in accordance with one or more embodiments. As shown in FIG. 2A, in some embodiments, the battery cell storage and transportation tray 202*a* is configured to hold battery cells 204*a* in a vertical orientation. In particular, as shown, the battery cell storage and transportation tray 202*a* includes a plurality (e.g., five, nine, etc.) of slots on a top side of the battery cell storage and transportation tray 202*a*, with each slot configured to partially enclose a lower portion (e.g., approximately a lower half) of a battery cell 204*a*.

In some cases, this configuration of the battery cell storage and transportation tray 202*a* facilitates loading of battery cells 204*a*. For instance, a robot arm or a person can hold a pouch portion of a battery cell 204*a*, place the battery cell 204*a* into a slot of the battery cell storage and transportation tray 202*a*, and release the pouch portion such that the battery cell 204*a* remains in the slot of the battery cell storage and transportation tray 202*a*.

Figure 2B:
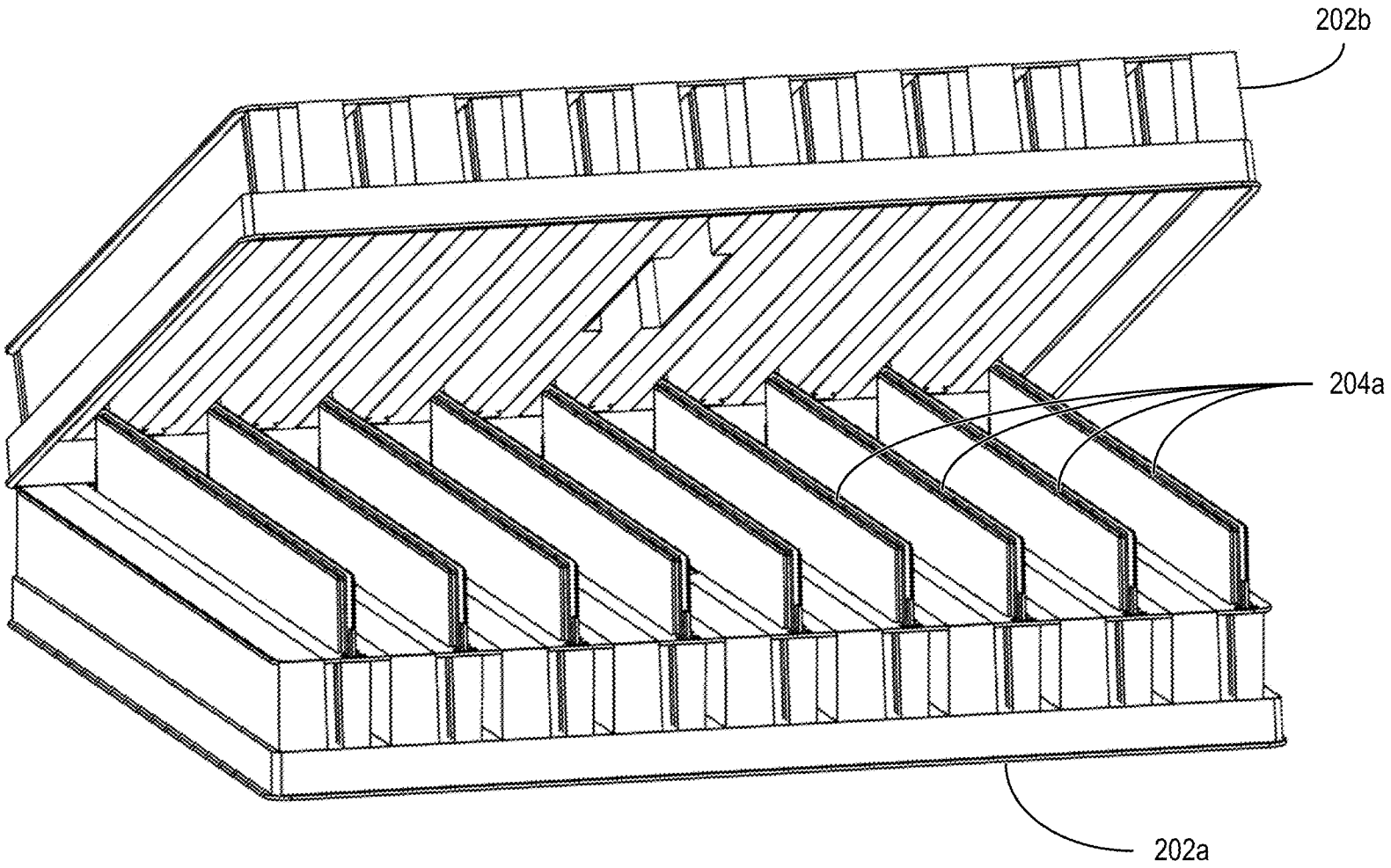
FIG. 2B illustrates a perspective view of a first tray filled with battery cells and a second tray being placed over the first tray in accordance with one or more embodiments.

In some implementations, with the first set of battery cells 204*a* positioned in the first battery cell storage and transportation tray 202*a*, a second battery cell storage and transportation tray 202*b* can be stacked on the first battery cell storage and transportation tray 202*a* to fully enclose the first set of battery cells 204*a*. For example, FIG. 2B illustrates the second battery cell storage and transportation tray 202*b* being placed over the first battery cell storage and transportation tray 202*a*. To illustrate, the second battery cell storage and transportation tray 202*b* is lowered onto the first battery cell storage and transportation tray 202*a* to nest the battery cell storage and transportation trays 202*a*, 202*b* together.

In some embodiments, the battery cell storage and transportation tray 202*b* includes a plurality (e.g., five, nine, ten, or more) of slots in a bottom side of the battery cell storage and transportation tray 202*b*, with each slot configured to partially enclose an upper portion (e.g., approximately an upper half) of a battery cell 204*a* of the first set of battery cells 204*a*. While FIG. 2B illustrates a battery cell storage and transportation tray 202*a* with a single row of slots, in alternative implementations as explained in further detail below, the battery cell storage and transportation system includes battery cell storage and transportation trays that have more than one row of slots (e.g., two, three, four, five, or more).

In some implementations, the combination of the slot on the top side of the first battery cell storage and transportation tray 202*a* with the slot in the bottom side of the second battery cell storage and transportation tray 202*b* provides a full enclosure for a battery cell of the first set of battery cells 204*a*. For instance, when the second battery cell storage and transportation tray 202*b* is stacked on the first battery cell storage and transportation tray 202*a*, the first set of battery cells 204*a* is fully enclosed.

For example, each battery cell of the first set of battery cells 204*a* can be individually enclosed within an individual pocket formed by a slot of the first battery cell storage and transportation tray 202*a* joined with a slot of the second battery cell storage and transportation tray 202*b*. In this way, the battery cells 204*a* can be isolated from each other and from other equipment, thereby mitigating potential occurrences of short circuits or accidental activation of the equipment.

Figure 2C:
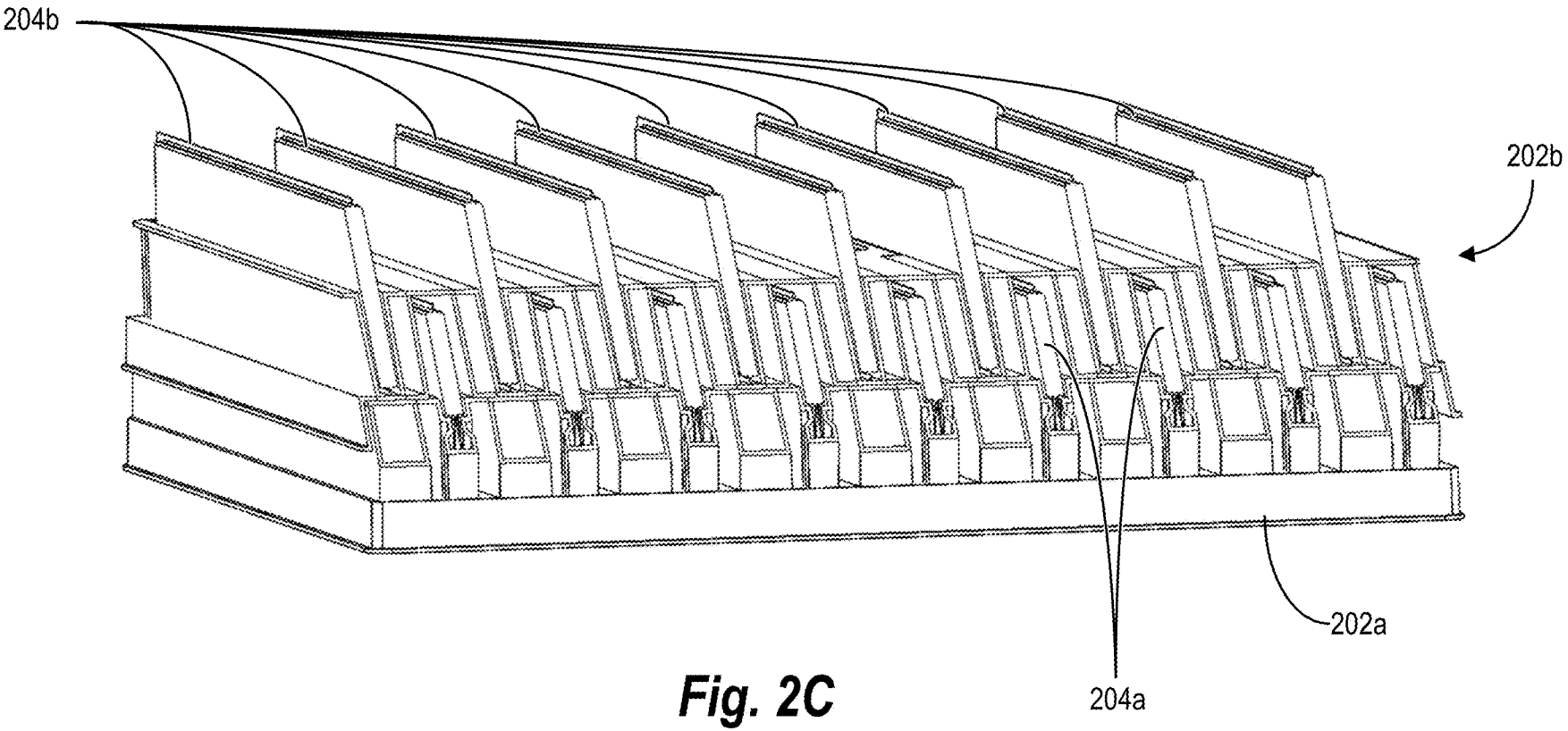
FIG. 2C illustrates a perspective cutaway view of a first tray filled with battery cells and a second tray filled with battery cells positioned above the first tray in accordance with one or more embodiments.

As shown in FIG. 2C, in some embodiments, the battery cell storage and transportation trays 202*a*, 202*b* stack one on top of the other to fully encapsulate the set of battery cells 204*a*. As also shown in FIG. 2C, a second set of battery cells 204*b* can be inserted into the upper side of the second battery cell storage and transportation tray 202*b*. In this way, the battery cell storage and transportation system can include multiple battery cell storage and transportation trays that can be nested modularly to enlarge the carrying capacity of the battery cell storage and transportation system.

As further shown in FIG. 2C, the first and second battery cell storage and transportation trays 202*a*, 202*b* can include discrete slots (for holding battery cells of the first and second sets of battery cells 204*a*, 204*b*) that are staggered one from each other in an offset pattern in one axis, yet overlapping each other in another axis. For example, the second battery cell storage and transportation tray 202*b* has a second series of slots that is laterally offset from, but vertically overlapping with (and longitudinally aligned with) a first series of slots of the first battery cell storage and transportation tray 202*a*. This configuration of the first and second battery cell storage and transportation trays 202*a*, 202*b* can increase the storage capacity of the battery cell storage and transportation system, thereby enhancing its utility.

As mentioned, in some embodiments, the slots of the battery cell storage and transportation trays (and, resultingly, the positions of battery cells when the trays are filled) can be positioned with an offset in a lateral axis (e.g., across the width of the view of FIG. 2C) such that a first set of battery cells in a first tray are staggered from a second set of battery cells in an adjacent tray. As also mentioned, in some embodiments, the slots of the battery cell storage and transportation trays can be aligned in a longitudinal axis (e.g., into the depth of the view of FIG. 2C) and can be overlapping in a vertical axis (e.g., across the height of the view of FIG. 2C).

Figure 6A:
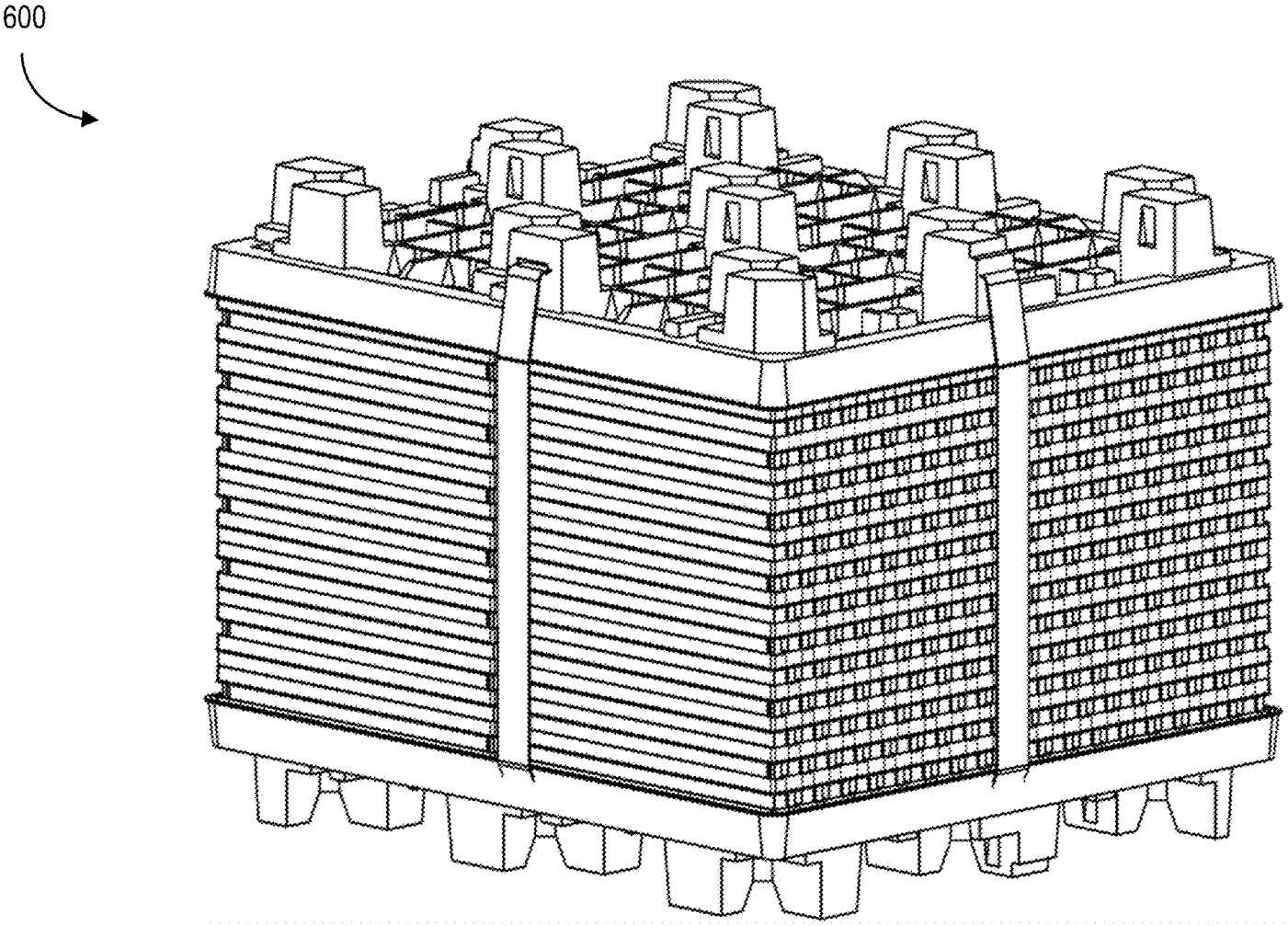
FIG. 6A illustrates a battery cell storage and transportation system as an assembled pallet of trays containing battery cells in accordance with one or more embodiments.

This configuration of vertical overlap, lateral staggering, and longitudinal alignment between the first plurality of battery cells 204*a* in the first battery cell storage and transportation tray 202*a* and the second plurality of battery cells 204*b* in the second battery cell storage and transportation tray 202*b* can allow for a more compact overall size of a packaged battery cell storage and transportation system (e.g., as shown in FIG. 6A) as compared with prior systems. For instance, the staggered lateral and overlapping vertical configuration of slots across multiple trays (e.g., as shown in FIG. 2C) can increase the number of battery cells stored in a given total volume of the battery cell storage and transportation system, while maintaining safety requirements such as keeping the battery cells electrically isolated, and while maintaining operational handling flexibility such as the ability of a robotic end effector to insert battery cells into and/or remove battery cells from the trays.

Furthermore, in some cases, the lateral offset of the slots of the first battery cell storage and transportation tray 202*a* to the slots of the second battery cell storage and transportation tray 202*b* helps to provide isolation of the first set of battery cells 204*a* from the second set of battery cells 204*b*. Thus, the battery cell storage and transportation system facilitates the electrical insulation of the battery cells from one another (e.g., to increase safety), while layering the battery cells as close to one another as possible (e.g., to optimize space). In particular, as shown in FIG. 2C, the slots of the first battery cell storage and transportation tray 202*a* are horizontally (e.g., laterally) offset from the slots of the second battery cell storage and transportation tray 202*b*. Additionally, the top portions of the first set of battery cells 204*a* overlap with the bottom portions of the second set of battery cells 204*b* to help reduce a height of the stacked configuration of battery cell storage and transportation trays 202*a*, 202*b*.

In some embodiments, the height of one battery cell storage and transportation tray is approximately equal to (or slightly greater than) half of the height of a battery cell (when the battery cell is placed in the tray in a vertical orientation). Thus, a stack of two trays has an overall height of approximately the height of one row of battery cells. Similarly, a stack of four trays has an overall height of approximately twice the height of one row of battery cells. However, given the staggered configuration shown in FIG. 2C, a stack of three trays can fully enclose two rows of battery cells, and a stack of five trays can fully enclose four rows of battery cells. In this way, the battery cell storage and transportation system can provide efficient use of storage and transportation space while preserving operational capabilities of robotic end effectors to manipulate (insert and/or remove) the battery cells. For example, a single tray (i.e., when not stacked with other trays) allows battery cells to protrude above a top surface of the tray to facilitate the end effector in grasping the battery cells.

Moreover, in some embodiments, the first and second battery cell storage and transportation trays 202*a*, 202*b* each have an identical configuration. For example, the first battery cell storage and transportation tray 202*a* and the second battery cell storage and transportation tray 202*b* can be two units of the same product (e.g., they have the same part number).

In some implementations, the battery cell storage and transportation trays 202*a*, 202*b* are made to nest with each other by orienting one tray opposite the other tray. For instance, the first battery cell storage and transportation tray 202*a* is a first unit from a stock of battery cell storage and transportation trays, and the second battery cell storage and transportation tray 202*b* is a second unit from the stock of battery cell storage and transportation trays (e.g., the two trays have an identical configuration). The trays can be stacked in opposite orientations by rotating the second battery cell storage and transportation tray 202*b* by a half circle (i.e., 180 degrees) relative to the first battery cell storage and transportation tray 202*a* and then placing the second battery cell storage and transportation tray 202*b* onto the first battery cell storage and transportation tray 202*a* (e.g., after filling the first battery cell storage and transportation tray 202*a* with battery cells 204*a*). Such configuration of the trays can simplify their manufacture (e.g., the trays have the same form factor) while providing efficient use of space (e.g., the trays, when stacked, provide compact storage of a large number of battery cells).

Figure 3:
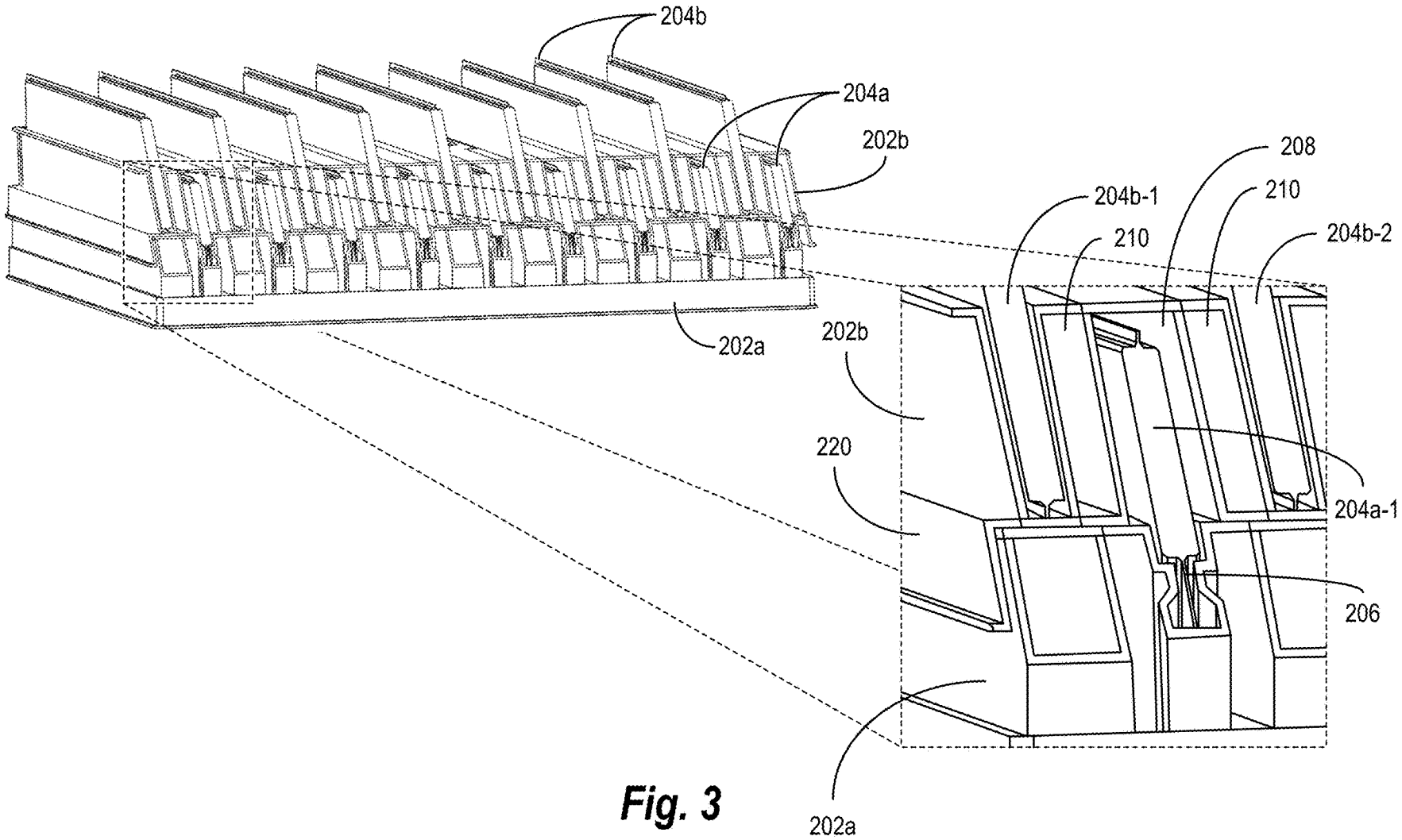
FIG. 3 illustrates a perspective cutaway view and a detail view of two trays of a battery cell storage and transportation system, with the two trays layered one on top of the other, and with battery cells stored within enclosures of the trays in accordance with one or more embodiments.

FIG. 3 illustrates a cutaway view of the first and second battery cell storage and transportation trays 202*a*, 202*b* of FIGS. 2A-2C. In the view of FIG. 3, the battery cell storage and transportation trays 202*a*, 202*b* are stacked one on top of the other and populated with sets of battery cells 204*a*, 204*b*. As discussed above, the battery cell storage and transportation trays 202*a*, 202*b*, when nested together, form individual cavities to fully encapsulate individual battery cells.

As shown in the detail-view portion of FIG. 3, in one or more implementations, the first battery cell storage and transportation tray 202*a* (i.e., the lower tray) holds a battery cell 204*a*-1 in a discrete slot 206. The discrete slot 206 is one of several discrete slots in a top surface of the first battery cell storage and transportation tray 202*a*. The discrete slot 206 can hold a lower portion of the battery cell 204*a*-1.

In some embodiments, a bottom of the slot 206 includes a cavity to isolate a terminal of the battery cell 204*a*-1 (e.g., to protect the terminal from accidental contact or damage). Additionally, or alternatively, in some embodiments, one or more ends of the slot 206 includes a cavity to isolate a terminal of the battery cell 204*a*-1 (e.g., to protect the terminal from accidental contact or damage). These features are described with additional detail below, in connection with FIGS. 5A-5B.

In some implementations, the second battery cell storage and transportation tray 202*b* nests over the first battery cell storage and transportation tray 202*a* to encapsulate the battery cells 204*a*. For example, the second battery cell storage and transportation tray 202*b* (i.e., the upper tray) has a discrete slot 208 to partially contain the battery cell 204*a*-1. The discrete slot 208 is one of several discrete slots in a bottom portion of the second battery cell storage and transportation tray 202*b*. To illustrate, the discrete slot 208 on the underside of the second battery cell storage and transportation tray 202*b* joins with the discrete slot 206 on the topside of the first battery cell storage and transportation tray 202*a* to form a discrete cavity that fully contains the battery cell 204*a*-1.

Furthermore, in some embodiments, the battery cell storage and transportation trays 202*a*, 202*b* contain barriers 210 to separate the battery cell 204*a*-1 from other batteries (e.g., from a first upper battery cell 204*b*-1 and from a second upper battery cell 204*b*-2 contained in slots of the second battery cell storage and transportation tray 202*b*). In some implementations, the barriers 210 are double-layer barriers that include a first wall, a gap, and a second wall. The gap can be an air gap, a vacuum gap, or a gap filled with an additional material such as a fire suppressant. The fire suppressant can be a material used to prevent or mitigate fires, such as Vermiculite, Perlite, Expanded Clay, Expanded Polystyrene (EPS), foam glass, a silica gel impregnated with a fire-retardant substance (e.g., water), fire resistant or insulating fibers and papers, and other fire, heat, and/or smoke suppressant compounds or a combination thereof.

To further illustrate, a wall between a slot on the top side and an adjacent slot on the bottom side of a tray can be a double-layer barrier. The double-layer barriers can provide added protection against accidental short circuiting or activation of equipment during storage and/or transit of the battery cells. For example, an accidental damage to one wall of the double-layer barrier can be mitigated by the presence of the other wall. Alternately, in some implementations, the barriers 210 are solid walls throughout.

In some embodiments, the battery cell storage and transportation trays include an overhang at least partially around a perimeter of the tray (e.g., on one or more sides of the tray) that facilitates repelling dust, water, and/or environmental debris. For instance, in some implementations, the second battery cell storage and transportation tray 202*b* has overhang 220 on all four sides that overlaps (e.g., by one inch, by two centimeters, etc.) the first battery cell storage and transportation tray 202*a* when the two trays are stacked together. The overhang can protect the battery cells 204*a* (e.g., the battery cells contained in cavities formed by the two trays) from contamination of dust, water, or other debris.

Figure 4:
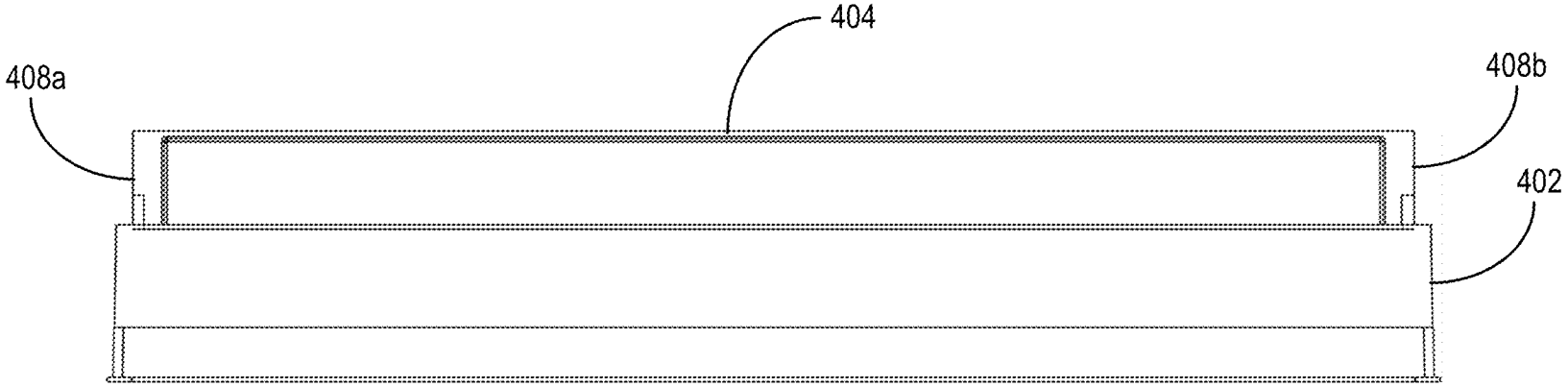
FIG. 4 illustrates an end view of a tray with a battery cell inserted vertically into the tray in accordance with one or more embodiments.

In certain embodiments, the battery cell storage and transportation trays can hold a battery cell vertically upright. For instance, FIG. 4 illustrates an end view of a battery cell storage and transportation tray 402, in accordance with one or more embodiments. Additionally, FIG. 4 illustrates an upper portion of a battery cell 404 protruding from the battery cell storage and transportation tray 402. The battery cell 404 can be oriented vertically in the battery cell storage and transportation tray 402 (e.g., such that the smallest dimension (thickness) of the battery cell 404 is oriented horizontally). This can facilitate placement of the battery cells into the battery cell storage and transportation tray.

In some cases, the battery cell 404 has terminals (e.g., terminal tabs) on either end of the battery cell 404. For example, the battery cell 404 has a first terminal 408*a* at a first end and a second terminal 408*b* at a second end. Moreover, in some embodiments, the battery cell storage and transportation tray 402 includes cavities carved out on either side for containing the terminals 408*a*, 408*b* of the battery cell 404. Thus, for example, the battery cell storage and transportation tray 402 includes dedicated spaces where the terminals 408*a*, 408*b* of the battery cell 404 are isolated from other terminal ends of other battery cells and from other equipment. In this way, the battery cell storage and transportation tray 402 facilitates safety by mitigating a risk of accidental activation of equipment and/or short circuits during storage and/or transportation of the battery cells.

Figure 5A:
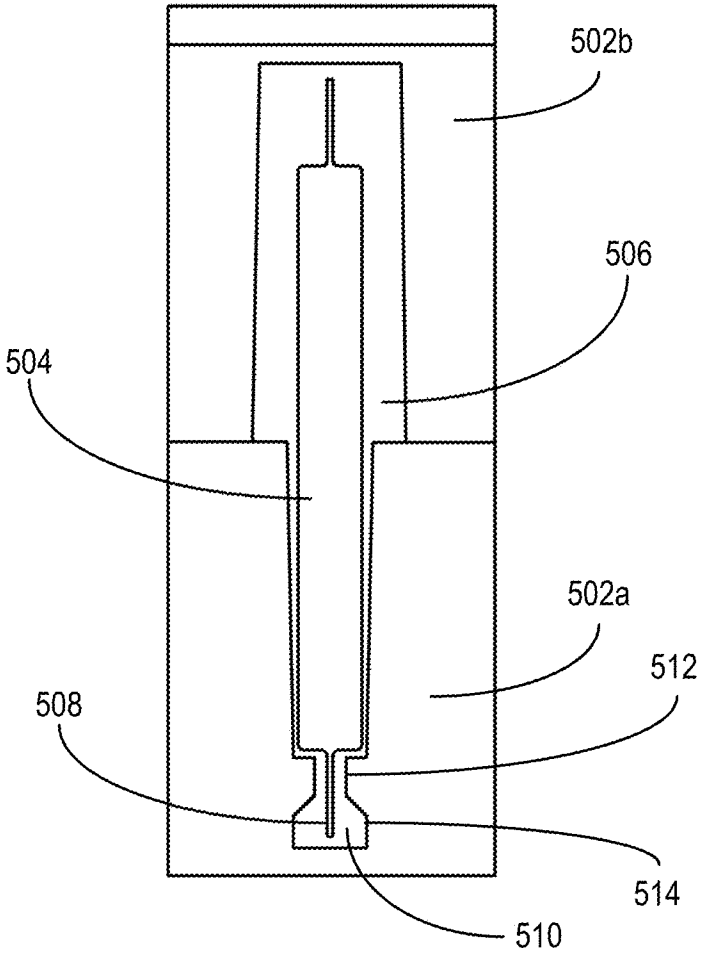
FIG. 5A illustrates a side cross-sectional view of a battery cell inserted vertically into a first tray, and a second tray stacked above the first tray to form a full enclosure for the battery cell in accordance with one or more embodiments.

FIG. 5A illustrates a partial side cross-sectional view of two battery cell storage and transportation trays forming a cavity around an individual battery cell. In particular, a first battery cell storage and transportation tray 502*a* is positioned beneath a second battery cell storage and transportation tray 502*b*. As shown, the first and second battery cell storage and transportation trays 502*a*, 502*b* fit together in a nested configuration. When nested together, the lower battery cell storage and transportation tray 502*a* and the upper battery cell storage and transportation tray 502*b* form a cavity 506 that can encapsulate a battery cell 504. As also shown, in some embodiments, the battery cell 504 is oriented vertically in the trays. The vertical orientation can facilitate placement of the battery cells into the lower tray (e.g., by robotics or manually), while also allowing for compact and efficient use of space in the battery cell storage and transportation system.

Furthermore, in some embodiments, the cavity 506 includes a terminal end cavity 510 for isolating a terminal end 508 of the battery cell 504. For example, the terminal end cavity 510 is a pocket formed in the first battery cell storage and transportation tray 502*a* that is dedicated for the terminal end 508 to isolate the terminal end 508 against incidental contact or damage (e.g., accidental damage caused during placement of the battery cell 504 into the battery cell storage and transportation tray 502*a* and/or caused by shifting of the battery cell 504 during transit).

In some embodiments, the terminal end cavity 510 includes a narrow neck 512 adjacent the cavity 506 and a wider opening 514 opposite the cavity 506. For example, the narrow neck 512 can support the pouch portion of the battery cell 504 during storage and transit, while the wider opening 514 offers space for the terminal end 508 to avoid accidental damage (e.g., by contacting against the wall of the terminal end cavity 510). In some embodiments, the narrow neck 512 includes a shelf on which the battery cell 504 can rest. Additionally, in some embodiments, the wider opening 514 has a tapered wall followed by parallel walls (e.g., forming a pentagonal or hexagonal shape).

In some embodiments, the first and second battery cell storage and transportation trays 502*a*, 502*b* comprise a polymer material (e.g., high-density polyethylene (HDPE), recycled high-density polyethylene (rHDPE), etc.). In some implementations, the polymer material is corrosive resistant to facilitate resistance to electrolyte corrosiveness. Furthermore, in some cases, the polymer material is strong and rigid (e.g., to support the battery cells in position and to withstand weight from additional trays stacked above) and non-conductive (e.g., to mitigate potential for short circuits).

Moreover, in some embodiments, the first and second battery cell storage and transportation trays 502*a*, 502*b* each comprise a solid material throughout the tray. Alternatively, in some embodiments, one or both of the first and second battery cell storage and transportation trays 502*a*, 502*b* comprise hollow portions (e.g., as described above in connection with FIG. 3) that contribute a double layer polymer barrier between battery cells.

Figure 5B:
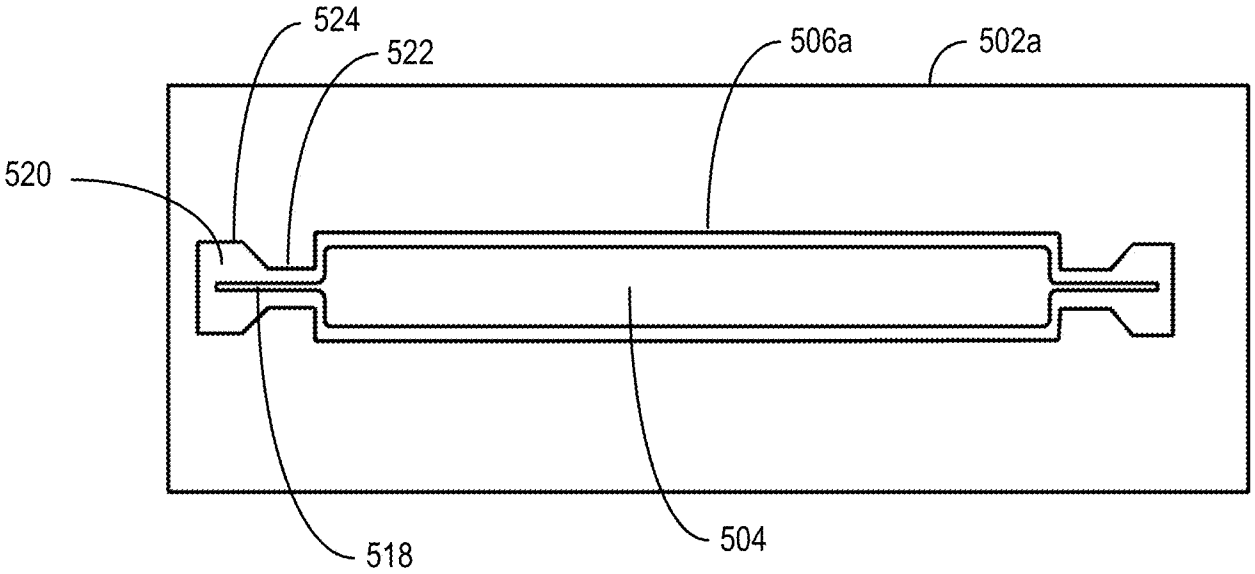
FIG. 5B illustrates a top cross-sectional view of a battery cell inserted vertically into a battery cell storage and transportation tray in accordance with one or more embodiments.

FIG. 5B illustrates a partial top cross-sectional view of the first battery cell storage and transportation tray 502*a* holding the battery cell 504 in a slot 506*a*. As shown, in some cases, the battery cell 504 includes a terminal 518 (e.g., a terminal tab) on one or both ends of the battery cell 504. In some embodiments, the slot 506*a* of the battery cell storage and transportation tray 502*a* includes a terminal cavity 520 on one or both sides of the slot 506*a*. The terminal cavity 520 can facilitate isolation of the terminal 518 of the battery cell 504. For example, the terminal cavity 520 is a pocket formed in the battery cell storage and transportation tray 502*a* that is dedicated for the terminal 518 to isolate the terminal 518 against incidental contact or damage (e.g., accidental damage caused during placement of the battery cell 504 into the battery cell storage and transportation tray 502*a* and/or caused by shifting of the battery cell 504 during transit).

In some embodiments, the terminal cavity 520 includes a narrow neck 522 adjacent a middle portion of the slot 506*a* and a wider opening 524 opposite the middle portion of the slot 506*a*. For example, the narrow neck 522 can support the pouch portion of the battery cell 504 during storage and transit, while the wider opening 524 offers space for the terminal 518 to avoid accidental damage (e.g., by contacting against the wall of the terminal cavity 520). In some embodiments, the narrow neck 522 includes a shelf against which the battery cell 504 can rest. Additionally, in some embodiments, the wider opening 524 has a tapered wall followed by parallel walls (e.g., forming a pentagonal or hexagonal shape).

As mentioned, in some embodiments, a battery cell storage and transportation system includes several stacked battery cell storage and transportation trays that can fill a pallet footprint. FIG. 6A illustrates a battery cell storage and transportation system 600 that is palletized for transport and/or storage, according to one or more embodiments. The battery cell storage and transportation system 600 includes several (e.g., fifty-six, one hundred, etc.) battery cell storage and transportation trays stacked one on top of another. Thus, the battery cell storage and transportation system 600 can store numerous (e.g., five hundred and four, one thousand, etc.) battery cells. In some embodiments, a battery cell storage and transportation system includes multiple (e.g., four, eight, etc.) stacks of battery cell storage and transportation trays positioned side-by-side on a pallet base. By way of example, and not limitation, the battery cell storage and transportation system 600 includes four stacks of battery cell storage and transportation trays in a two-by-two grid configuration, with each stack containing fourteen battery cell storage and transportation trays. Again, by way of example, and not limitation, each battery cell storage and transportation tray in the battery cell storage and transportation system 600 can store nine battery cells, for a total storage capacity of five hundred and four battery cells in the battery cell storage and transportation system 600.

Furthermore, as illustrated in FIG. 6A, in certain embodiments, the battery cell storage and transportation system can be secured with webbed belts and reinforced steel buckles to secure the battery cell storage and transportation trays together. For example, the webbed belts and reinforced steel buckles secure the battery cell storage and transportation trays on the pallet base. The webbed belts and steel buckles can continuously constrict the trays together to keep the battery cell storage and transportation system unitized as a package for transit. For instance, when the battery cell storage and transportation trays are secured together, the battery cell storage and transportation system comprises a single palletized unit that can facilitate transportation and/or storage of the battery cells. Moreover, in some embodiments, the battery cell storage and transportation system can be additionally secured with an optional outer protective layer (e.g., a metal or polymer sheet) on each side of the palletized package.

Figure 6B:
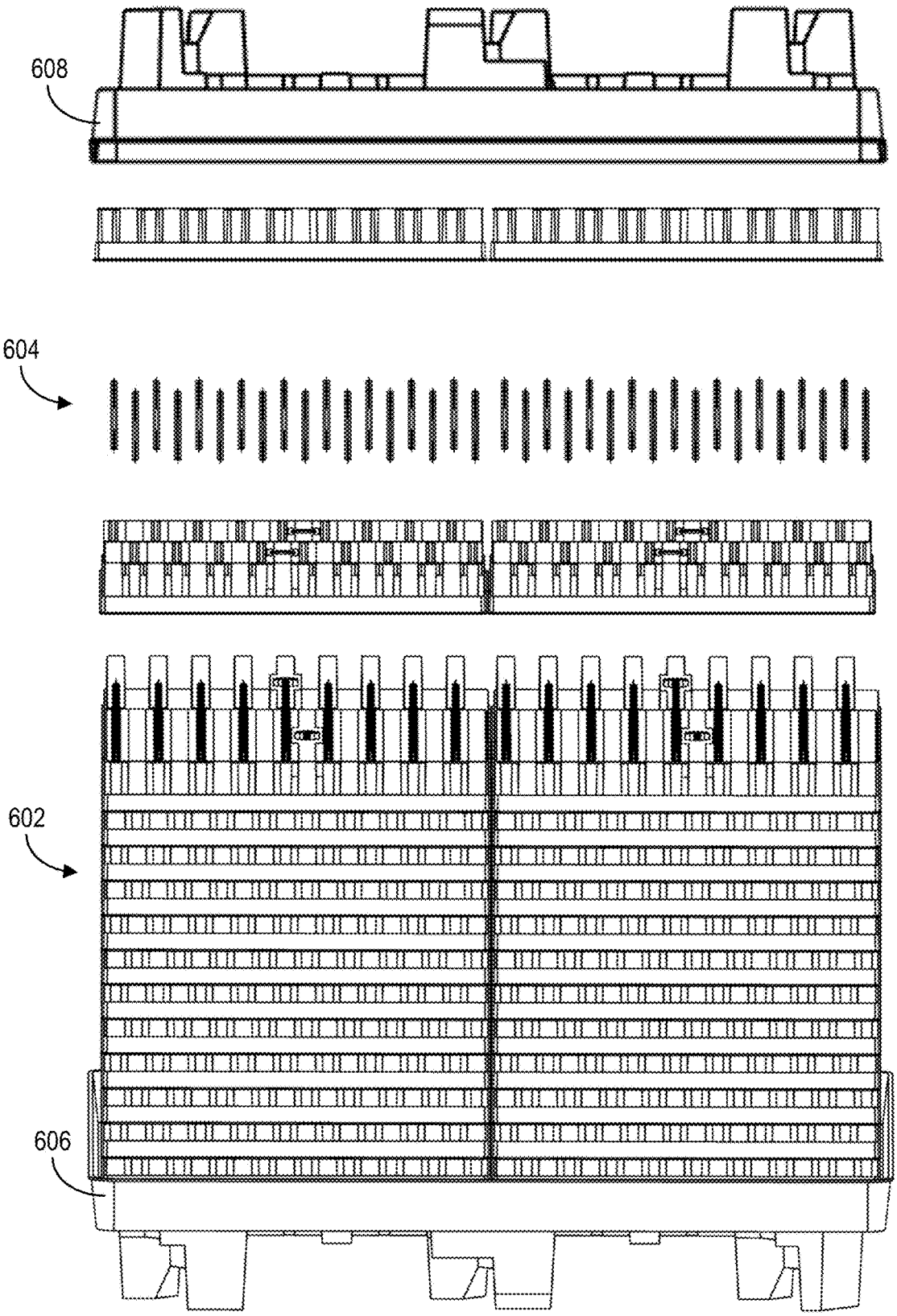
FIG. 6B illustrates an exploded view of the battery cell storage and transportation system of FIG. 6A in accordance with one or more embodiments.

FIG. 6B illustrates an exploded view of the battery cell storage and transportation system 600. In one or more implementations, the battery cell storage and transportation system 600 includes a plurality of battery cell storage and transportation trays 602 in a nested configuration. The battery cell storage and transportation trays 602 can contain battery cells 604 for storage and/or transportation. Additionally, the battery cell storage and transportation trays 602 rest on a pallet base 606. Furthermore, the battery cell storage and transportation trays 602 can be capped with a lid 608. The lid 608, in some embodiments, can be formed from a custom designed thermoformed material.

The components of the battery cell storage and transportation system 600 (e.g., the battery cell storage and transportation trays 602, the pallet base 606, the lid 608, the webbed belt and steel buckles, and/or the outer protective layer) can be reused numerous times for storing and/or transporting used battery cells. This can help reduce further waste of material and provide added efficiency in the storage and transportation of battery cells.

Figure 7A:
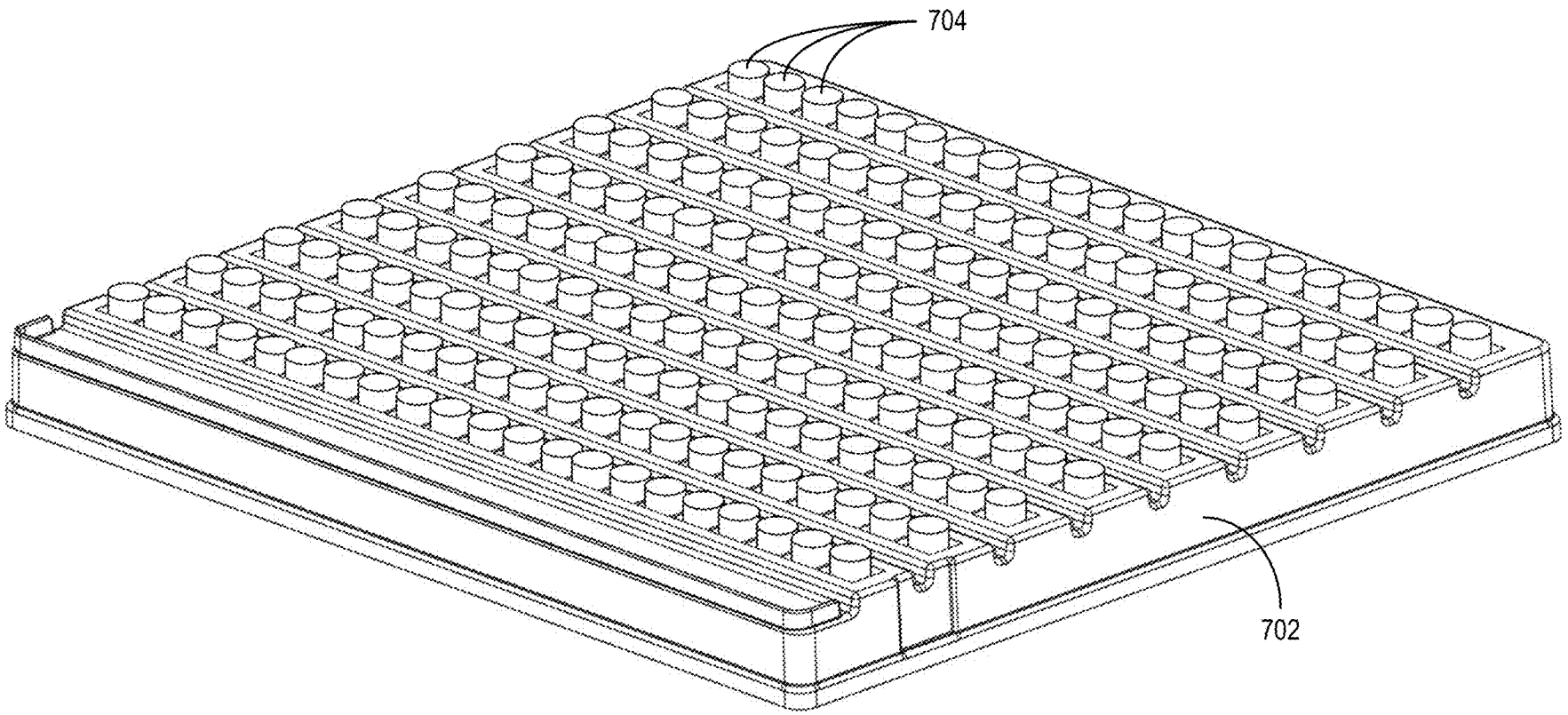
FIG. 7A illustrates a perspective view of a tray of a battery cell storage and transportation system with battery cells positioned in slots of the tray in accordance with one or more embodiments.

FIG. 7A illustrates a perspective view of a tray of a battery cell storage and transportation system with battery cells positioned in slots of the tray in accordance with one or more embodiments. In particular, FIG. 7A shows a battery cell storage and transportation tray 702 populated with battery cells 704. As shown, the battery cells 704 are cylindrical cells. Indeed, the various embodiments of battery cell storage and transportation systems disclosed herein can support a variety of battery cell types. For example, in some embodiments, the battery cell storage and transportation trays can hold pouch cells. As another example, in some embodiments, the battery cell storage and transportation trays can hold prismatic cells. As an additional example, in some embodiments, the battery cell storage and transportation trays can hold cylindrical cells or cells of other shapes or configurations.

Moreover, as shown in FIG. 7A, in some embodiments, the battery cell storage and transportation trays have a plurality of rows and columns of slots (e.g., an array of slots in a horizontal plane of the tray) for holding battery cells. For example, while the battery cell storage and transportation tray 202*a* shown in FIG. 2B (and described above) has just one row of slots to hold the battery cells 204*a* (e.g., a plurality of slots in a lateral axis while just one row in a longitudinal axis), in other embodiments, the battery cell storage and transportation trays have multiple rows of slots to hold an array of battery cells. For example, the battery cell storage and transportation tray 702 has multiple rows of slots, where each row has a plurality of individual slots. The slots in each row are separated from each other by isolations walls 710 to ensure that each battery cell is isolated from adjacent cells in the same row.

Figure 7B:
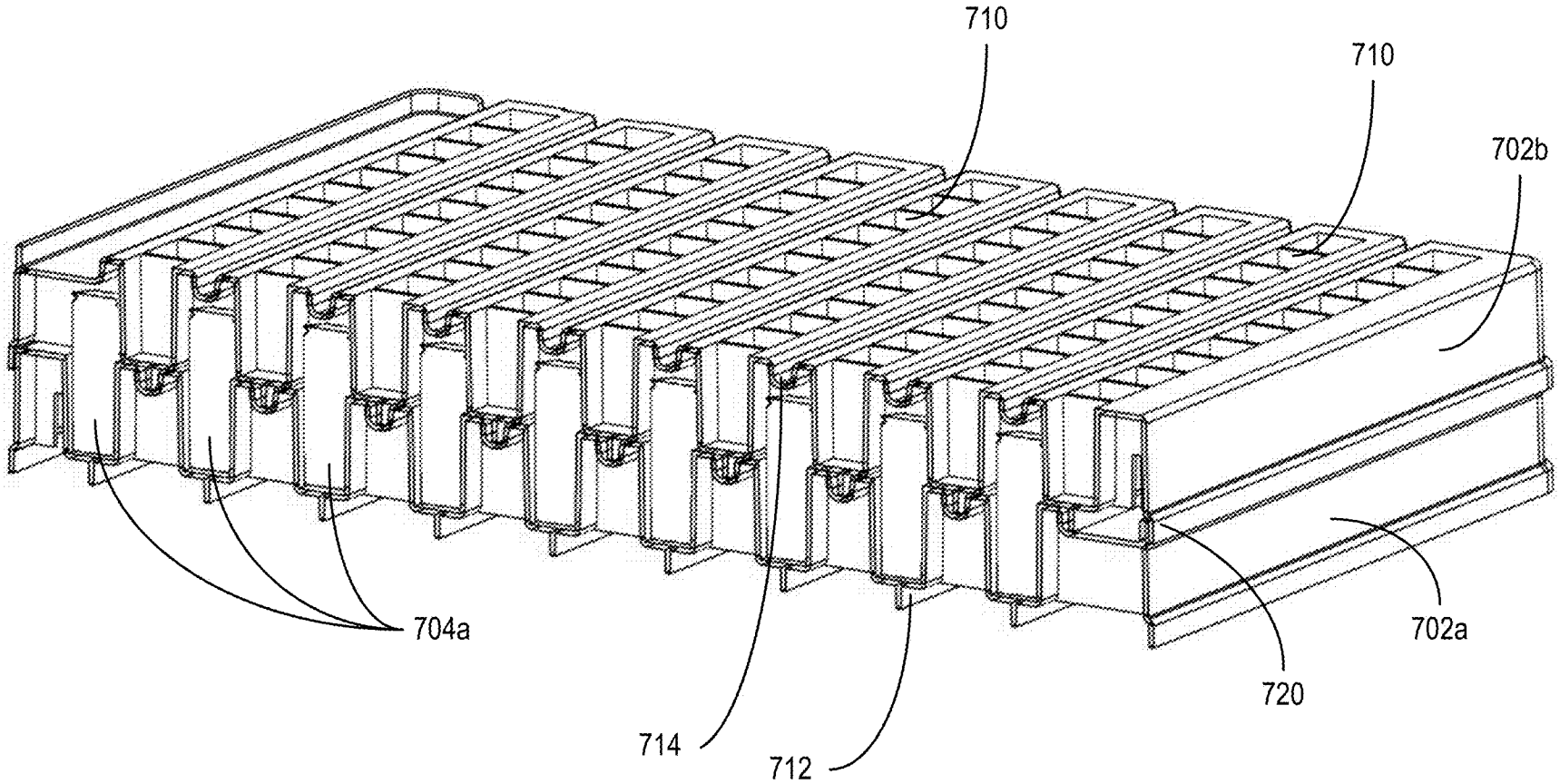
FIG. 7B illustrates a perspective cutaway view of a first tray filled with battery cells and a second tray positioned above the first tray in accordance with one or more embodiments.

FIG. 7B illustrates a perspective cutaway view of a first tray filled with battery cells and a second tray positioned above the first tray in accordance with one or more embodiments. In particular, FIG. 7A shows a first battery cell storage and transportation tray 702*a*. The battery cell storage and transportation tray 702*a* is populated with a plurality of battery cells 704*a*. As shown, the battery cells 704*a* (shown in cutaway view, with half of each cell removed from view) are cylindrical cells. In other embodiments, the slots of the battery cell storage and transportation trays support other types and shapes of battery cells.

Additionally, FIG. 7B shows a second battery cell storage and transportation tray 702*b* stacked on the first battery cell storage and transportation tray 702*a*. Thus, the first and second battery cell storage and transportation trays 702*a*, 702*b* together enclose the battery cells 704*a*, in a similar manner to the embodiments described above (e.g., in connection with FIG. 3). For example, each slot on the top side of the first battery cell storage and transportation tray 702*a* can align with a corresponding slot on the bottom side of the second battery cell storage and transportation tray 702*b* to provide a full enclosure for a battery cell 704*a* that electrically isolates the battery cell from other battery cells and from other equipment.

In one or more embodiments, the battery cell storage and transportation trays include one or more features to aid in aligning the trays when stacking them on top of each other. For example, as shown in FIG. 7B, in one or more embodiments, an underside of each tray includes a protrusion 712 extending away from a bottom surface beneath each bottom row of slots. The top of each battery cell storage and transportation tray includes a channel 714 extending into a top surface of each top row of slots. The channels 714 are sized and configured to receive the protrusions 712 to help ensure that the battery cell storage and transportation trays are aligned when stacked on top of each other.

As explained above, the battery cell storage and transportation trays include an overhang at least partially around a perimeter of the tray (e.g., on one or more sides of the tray) that facilitates repelling dust, water, and/or environmental debris. For instance, in some implementations, the second battery cell storage and transportation tray 702*b* has overhang 720 on all four sides that overlaps (e.g., by one inch, by two centimeters, etc.) the first battery cell storage and transportation tray 702*a* when the two trays are stacked together. The overhang can protect the battery cells 704*a* (e.g., the battery cells contained in cavities formed by the two trays) from contamination of dust, water, or other debris.

Moreover, as similarly described above in connection with FIG. 3, the second battery cell storage and transportation tray 702*b* can hold additional battery cells that likewise can be encapsulated upon placing a third battery cell storage and transportation tray on top of the second battery cell storage and transportation tray 702*b*. In the embodiment shown, these additional battery cells, when placed in the second battery cell storage and transportation tray 702*b*, will be laterally offset, longitudinally aligned, and vertically overlapping the battery cells 704*a*. In this way, the battery cell storage and transportation system can provide efficient use of space while maintaining safety and operational requirements, as similarly described above in connection with the embodiments shown in FIGS. 1-6B.

Examples

The following are some example embodiments within the scope of the disclosure. In order to avoid complexity in providing the disclosure, not all of the examples listed below are separately and explicitly disclosed as combinable with all of the others of the examples listed below and other embodiments disclosed hereinabove. Unless one of ordinary skill in the art would understand that these examples listed below, and the above disclosed embodiments, are not combinable, it is contemplated within the scope of the disclosure that such examples and embodiments are combinable.

Example 1. A battery cell storage and transportation tray comprising: a first series of slots located on a top side of the battery cell storage and transportation tray, wherein a first slot of the first series of slots is configured to at least partially encapsulate a first battery cell for storage and transportation; and a second series of slots located on a bottom side of the battery cell storage and transportation tray, wherein a second slot of the second series of slots is configured to at least partially encapsulate a second battery cell for storage and transportation, wherein the second series of slots is laterally offset from and vertically overlapping the first series of slots.

Example 2. The battery cell storage and transportation tray of Example 1, wherein the battery cell storage and transportation tray is configured to stack with an additional tray of an identical configuration by nesting the top side of the battery cell storage and transportation tray with a bottom side of the additional tray.

Example 3. The battery cell storage and transportation tray of Example 2, wherein, when stacked with the additional tray, the first series of slots together with an additional series of slots on the bottom side of the additional tray provide full enclosures for a plurality of battery cells.

Example 4. The battery cell storage and transportation tray of any one of Examples 1-3, wherein the first series of slots is configured to receive a first plurality of vertically oriented battery cells.

Example 5. The battery cell storage and transportation tray of any one of Examples 1-4, further comprising an overhang at least partially around a perimeter of the battery cell storage and transportation tray, the overhang configured to overlap a portion of an additional tray when the battery cell storage and transportation tray is stacked with the additional tray.

Example 6. The battery cell storage and transportation tray of any one of Examples 1-5, further comprising a cavity at an end of the first slot of the first series of slots, the cavity configured to receive a terminal of the first battery cell.

Example 7. The battery cell storage and transportation tray of Example 6, further comprising a shelf between the cavity and the first slot.

Example 8. The battery cell storage and transportation tray of any one of Examples 1-7, further comprising a double-layer barrier between the first slot of the first series of slots and the second slot of the second series of slots.

Example 9. The battery cell storage and transportation tray of any one of Examples 1-8, wherein the second series of slots is longitudinally aligned with the first series of slots.

Example 10. The battery cell storage and transportation tray of any one of Examples 1-9, further comprising an electrolyte-corrosive-resistant polymer material.

Example 11. A battery cell storage and transportation system comprising: a first battery cell storage and transportation tray configured to hold a first plurality of battery cells; and a second battery cell storage and transportation tray configured to hold a second plurality of battery cells, and configured to be stacked on top of the first battery cell storage and transportation tray and enclose the first plurality of battery cells such that the first plurality of battery cells vertically overlap with the second plurality of battery cells.

Example 12. The battery cell storage and transportation system of Example 11, wherein, when the first and second battery cell storage and transportation trays are loaded respectively with the first and second pluralities of battery cells, the first plurality of battery cells is laterally staggered from the second plurality of battery cells.

Example 13. The battery cell storage and transportation system of any one of Examples 11-12, wherein the first battery cell storage and transportation tray comprises a first plurality of slots to receive the first plurality of battery cells, and wherein the second battery cell storage and transportation tray comprises a second plurality of slots to receive the second plurality of battery cells.

Example 14. The battery cell storage and transportation system of Example 13, wherein the second battery cell storage and transportation tray comprises a double-layer barrier between a second slot of the second plurality of slots and an adjacent slot on a bottom side of the second battery cell storage and transportation tray, the adjacent slot corresponding to a first slot of the first plurality of slots of the first battery cell storage and transportation tray.

Example 15. The battery cell storage and transportation system of any one of Examples 13-14, wherein the first battery cell storage and transportation tray comprises a cavity at an end of a first slot of the first plurality of slots, the cavity configured to receive a terminal of a first battery cell of the first plurality of battery cells.

Example 16. The battery cell storage and transportation system of Example 15, wherein the first battery cell storage and transportation tray further comprises a shelf between the cavity and the first slot.

Example 17. The battery cell storage and transportation system of any one of Examples 11-16, wherein: the first battery cell storage and transportation tray comprises a first configuration, the second battery cell storage and transportation tray comprises a second configuration identical to the first configuration, and the second battery cell storage and transportation tray is configured to be stacked on top of the first battery cell storage and transportation tray in an opposite orientation of the first battery cell storage and transportation tray.

Example 18. The battery cell storage and transportation system of any one of Examples 11-17, wherein the second battery cell storage and transportation tray comprises an overhang configured to overlap a portion of the first battery cell storage and transportation tray when stacked on top of the first battery cell storage and transportation tray.

Example 19. The battery cell storage and transportation system of any one of Examples 11-18, further comprising a belt configured to secure the first battery cell storage and transportation tray and the second battery cell storage and transportation tray together.

Example 20. The battery cell storage and transportation system of Example 19, wherein, when the first battery cell storage and transportation tray and the second battery cell storage and transportation tray are secured together, the battery cell storage and transportation system comprises a single palletized unit.

The use in the foregoing description and in the appended claims of the terms "first," "second," "third," etc., is not necessarily to connote a specific order or number of elements. Generally, the terms "first," "second," "third," etc., are used to distinguish between different elements as generic identifiers. Absent a showing that the terms "first," "second," "third," etc., connote a specific order, these terms should not be understood to connote a specific order. Furthermore, absent a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget, and not necessarily to connote that the second widget has two sides.

In the foregoing description, the invention has been described with reference to specific exemplary embodiments thereof. Various embodiments and aspects of the invention(s) are described with reference to details discussed herein, and the accompanying drawings illustrate the various embodiments. The description above and drawings are illustrative of the invention and are not to be construed as limiting the invention. Numerous specific details are described to provide a thorough understanding of various embodiments of the present invention.

The present invention may be embodied in other specific forms without departing from its spirit or essential characteristics. The described embodiments are to be considered in all respects only as illustrative and not restrictive. For example, the methods described herein may be performed with fewer or more steps/acts or the steps/acts may be performed in differing orders. Additionally, the steps/acts described herein may be repeated or performed in parallel with one another or in parallel with different instances of the same or similar steps/acts. The scope of the invention is, therefore, indicated by the appended claims rather than by the foregoing description. All changes that come within the meaning and range of equivalency of the claims are to be embraced within their scope.

What is claimed is:

1. A battery cell storage and transportation tray comprising:

a first series of slots located on a top side of the battery cell storage and transportation tray, wherein a first slot of the first series of slots is configured to at least partially encapsulate a first battery cell for storage and transportation;

a second series of slots located on a bottom side of the battery cell storage and transportation tray, wherein a second slot of the second series of slots is configured to at least partially encapsulate a second battery cell for storage and transportation;

a cavity at an end of the first slot of the first series of slots, the cavity configured to receive a terminal of the first battery cell; and a shelf between the cavity and the first slot, wherein the second series of slots is laterally offset from and vertically overlapping the first series of slots.

2. The battery cell storage and transportation tray of claim 1, wherein the battery cell storage and transportation tray is configured to stack with an additional tray of an identical configuration by nesting the top side of the battery cell storage and transportation tray with a bottom side of the additional tray.

3. The battery cell storage and transportation tray of claim 2, wherein, when stacked with the additional tray, the first series of slots together with an additional series of slots on the bottom side of the additional tray provide full enclosures for a plurality of battery cells.

4. The battery cell storage and transportation tray of claim 1, wherein the first series of slots is configured to receive a first plurality of vertically oriented battery cells.

5. The battery cell storage and transportation tray of claim 1, further comprising an overhang at least partially around a perimeter of the battery cell storage and transportation tray, the overhang configured to overlap a portion of an additional tray when the battery cell storage and transportation tray is stacked with the additional tray.

6. The battery cell storage and transportation tray of claim 1, wherein the cavity comprises a narrow neck adjacent the first slot and a wider opening opposite the first slot.

7. The battery cell storage and transportation tray of claim 1, further comprising a protrusion extending from the bottom side and a channel extending into the top side, the channel configured to receive a corresponding protrusion of an additional tray when the battery cell storage and transportation tray is stacked with the additional tray.

8. The battery cell storage and transportation tray of claim 1, further comprising a double-layer barrier between the first slot of the first series of slots and the second slot of the second series of slots.

9. The battery cell storage and transportation tray of claim 1, wherein the second series of slots is longitudinally aligned with the first series of slots.

10. The battery cell storage and transportation tray of claim 1, further comprising an electrolyte-corrosive-resistant polymer material.

11. A battery cell storage and transportation system comprising:

a first battery cell storage and transportation tray comprising a first plurality of slots configured to receive and hold a first plurality of battery cells, wherein the first battery cell storage and transportation tray further comprises a cavity at an end of a first slot of the first plurality of slots, the cavity configured to receive a terminal of a first battery cell of the first plurality of battery cells, and wherein the first battery cell storage and transportation tray further comprises a shelf between the cavity and the first slot; and a second battery cell storage and transportation tray configured to hold a second plurality of battery cells, and configured to be stacked on top of the first battery cell storage and transportation tray and enclose the first plurality of battery cells such that the first plurality of battery cells vertically overlap with the second plurality of battery cells.

12. The battery cell storage and transportation system of claim 11, wherein, when the first and second battery cell storage and transportation trays are loaded respectively with the first and second pluralities of battery cells, the first plurality of battery cells is laterally staggered from the second plurality of battery cells.

13. The battery cell storage and transportation system of claim 11, wherein the second battery cell storage and transportation tray comprises a second plurality of slots to receive the second plurality of battery cells.

14. The battery cell storage and transportation system of claim 13, wherein the second battery cell storage and transportation tray comprises a double-layer barrier between a second slot of the second plurality of slots and an adjacent slot on a bottom side of the second battery cell storage and transportation tray, the adjacent slot corresponding to a first slot of the first plurality of slots of the first battery cell storage and transportation tray.

15. The battery cell storage and transportation system of claim 13, wherein the second battery cell storage and transportation tray comprises a second cavity at an end of a second slot of the second plurality of slots, the second cavity configured to receive a second terminal of a second battery cell of the second plurality of battery cells.

16. The battery cell storage and transportation system of claim 15, wherein the second battery cell storage and transportation tray further comprises a second shelf between the second cavity and the second slot.

17. The battery cell storage and transportation system of claim 11, wherein:

the first battery cell storage and transportation tray comprises a first configuration, the second battery cell storage and transportation tray comprises a second configuration identical to the first configuration, and the second battery cell storage and transportation tray is configured to be stacked on top of the first battery cell storage and transportation tray in an opposite orientation of the first battery cell storage and transportation tray.

18. The battery cell storage and transportation system of claim 11, wherein the second battery cell storage and transportation tray comprises an overhang configured to overlap a portion of the first battery cell storage and transportation tray when stacked on top of the first battery cell storage and transportation tray.

19. The battery cell storage and transportation system of claim 11, further comprising a belt configured to secure the first battery cell storage and transportation tray and the second battery cell storage and transportation tray together.

20. The battery cell storage and transportation system of claim 19, wherein, when the first battery cell storage and transportation tray and the second battery cell storage and transportation tray are secured together, the battery cell storage and transportation system comprises a single palletized unit.

* * * * *